US008758676B2

(12) United States Patent
Voice et al.

(10) Patent No.: US 8,758,676 B2
(45) Date of Patent: Jun. 24, 2014

(54) METHOD OF MANUFACTURING A COMPONENT

(75) Inventors: Wayne E. Voice, Nottingham (GB); Junfa Mei, Birmingham (GB)

(73) Assignee: Rolls-Royce PLC, London (GB)

( * ) Notice: Subject to any disclaimer, the term of this patent is extended or adjusted under 35 U.S.C. 154(b) by 812 days.

(21) Appl. No.: 12/945,058

(22) Filed: Nov. 12, 2010

(65) Prior Publication Data

US 2011/0142709 A1 Jun. 16, 2011

(30) Foreign Application Priority Data

Dec. 16, 2009 (GB) ..... 0921896.7

(51) Int. Cl.
*B22F 3/15* (2006.01)
*B22F 3/16* (2006.01)

(52) U.S. Cl.
USPC ..... 419/28; 419/49; 419/54; 419/55

(58) Field of Classification Search
USPC ..... 419/28, 49, 53, 54, 55
See application file for complete search history.

(56) References Cited

U.S. PATENT DOCUMENTS 3,888,663 A * 6/1975 Reichman ..... 419/2
4,383,809 A 5/1983 Hoffmuller
6,357,272 B1 3/2002 Sandner
6,582,535 B1 6/2003 Suzuki et al.
2005/0084407 A1 * 4/2005 Myrick ..... 419/66
2007/0102199 A1 5/2007 Smith et al.

FOREIGN PATENT DOCUMENTS

EP 1 547 707 A2 6/2005
JP A-63-93802 4/1988
JP A-4-160104 6/1992
WO WO 87/05241 A1 9/1987
WO WO 2005/049251 A1 6/2005

OTHER PUBLICATIONS

British Search Report for Corresponding British Patent Application No. 0921896.7, dated Apr. 8, 2010.
European Search Report for corresponding European Patent Application No. 10190985, dated Mar. 28, 2011.
Jan. 2, 2014 Examination Report issued in European Patent Application No. 10 190 985.1.

* cited by examiner

*Primary Examiner* — George Wyszomierski
*Assistant Examiner* — Ngoclan T Mai
(74) *Attorney, Agent, or Firm* — Oliff PLC

(57) ABSTRACT

A component is manufactured from a powdered material such as a titanium alloy, by performing a first hot isostatic pressing HIP operation on the powdered material 14 while the powdered material is in contact with a molding surface 8 of a rigid, usable molding tool 2. The first HIP operation creates a non-porous shaped surface 16 on a partially consolidated component 14, but avoids bonding or reaction between the partially consolidated component 14 and the molding tool 2. After separation of the partially consolidated component 14 from the molding tool 2, the partially consolidated component 14 is subjected to a second HIP operation in which the powdered material is fully consolidated.

11 Claims, 4 Drawing Sheets

METHOD OF MANUFACTURING A COMPONENT

This invention relates to a method of manufacturing a component, and is particularly, although not exclusively, concerned with a method of manufacturing a component from an aerospace alloy, such as a titanium alloy.

Many aerospace components, and particularly gas turbine engine components, are made by substantial machining of work pieces produced by forging or cut from the bulk material. By way of example, it is known to manufacture compressor casings by ring-roll forging Ti 6/4 alloy and then immediately rough machining the forging to an axi-symmetrical cylindrical shape for non-destructive evaluation (NDE) before a final machining operation in which detailed features such as ribs, bosses and flanges are formed.

Such processes yield a low "fly-to-buy" ratio, which is the ratio of the mass of the finished part to the mass of material required to machine the part. The fly-to-buy ratio thus indicates the quantity of scrap generated in the machining process, as well as the extent of machining which is required. A low fly-to-buy ratio represents a substantial machining cost and a substantial cost in terms of expensive alloy material.

A hot isostatic pressing (HIP) process is known in which the alloy raw material, in powder form, is introduced into a specially shaped deformable canister, for example of mild steel. The canister is then subjected to isostatic pressing at an elevated temperature which causes the entire canister to be pressed inwardly, consolidating the powder. Before the pressing operation, the canister is evacuated, so that, during pressing, the particles of the powder bond together and substantially all voids are eliminated.

The initial form of the canister has to be carefully designed in order to yield a final product which, as far as possible, has the desired net shape of the component. Sophisticated modelling processes are used to determine the required initial shape of the canister, but nevertheless several iterations (i.e. trial HIP processes) are required to arrive at the optimum original canister shape. The design process is consequently expensive. The canister manufacturing process is also expensive. After completion of the HIP process, the canister needs to be removed from the consolidated component by machining and chemical dissolution. The canister is thus not reusable. Overall, the use of consumable canisters in conventional HIP processes for the production of components from titanium alloys has a long lead time and may be uneconomic.

According to the present invention there is provided a method of manufacturing a component, the method comprising:

(i) defining a mould cavity within a deformable envelope, a portion of the mould cavity being defined by a moulding surface of a rigid moulding tool;

(ii) introducing a porous powdered material into the mould cavity;

(iii) evacuating the mould cavity;

(iv) forming a partially consolidated component by subjecting the deformable envelope to a first external isostatic pressing operation at a first temperature, thereby to deform the envelope to consolidate the powdered material to such an extent that the powdered material in contact with the moulding surface forms a non-porous shaped surface;

(v) separating the partially consolidated component from the moulding surface; and (vi) forming a fully consolidated component by exposing the shaped surface to a fluid under pressure and subjecting the partially consolidated component to a second external isostatic pressing operation at a second temperature higher than the first temperature, thereby to consolidate the powdered material substantially fully.

The powdered material may be a metallic material, for example a titanium alloy.

The envelope may comprise a thin-walled metallic enclosure, for example of mild steel.

The moulding tool may be disposed entirely within the envelope. Thus, in the first external isostatic pressing operation, the envelope may accommodate both the moulding tool and the powdered material, so that the powdered material is in direct contact both with the moulding tool and with the envelope. The moulding tool may be one of at least two moulding tools which are displaceable towards one another upon deformation of the envelope during the first external isostatic pressing operation.

The porous powdered material may be introduced into the mould cavity as a loose powder which, for example, may be blown into the mould cavity in a stream of gas. In an alternative process, the porous powdered material may be introduced into the mould cavity as at least one powder preform.

After the partially consolidated component is separated from the moulding surface, and before the second external isostatic pressing operation, at least part of the envelope may be removed to enable separation of the or each moulding tool from the respective non-porous shaped surface.

The component may be an aerospace component, for example a component of a gas turbine engine. In a particular embodiment, the component is a casing of a gas turbine engine, for example a compressor casing.

The second external isostatic pressing operation may be conducted with part of the envelope attached to the partially consolidated component. Following the second external isostatic pressing operation, the attached part of the envelope may be removed from the fully consolidated component by a machining operation, which may comprise cutting through the substantially fully consolidated powdered material.

For a better understanding of the present invention, and to show more clearly how it may be carried into effect, reference will now be made, by way of example, to the accompanying drawings, in which.

Figure 1:
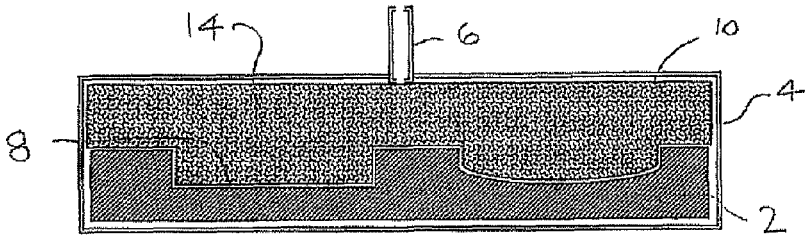
FIG. 1 represents, in a schematic form, a first step in the manufacture of a component.

FIG. 1 shows a rigid moulding tool 2 fully enclosed by an envelope or canister 4 which is provided with a powder supply passage 6. In FIG. 1, a space is shown between the tool 2 and the envelope 4, but this is for clarity purposes only. In practice, the tool 2 is a close fit in the envelope 4.

The moulding tool 2 is a rigid component, which may be made, for example, of a strong high temperature nickel based alloy or a ceramic material. The moulding tool 2 has a moulding surface 8 which is complementary to a profile which is close to the net shape of the finished component.

The envelope 4 comprises a thin sheet box, which may be fabricated from mild steel. That part of the interior of the envelope 4 which is not occupied by the moulding tool 2 constitutes a mould cavity 10.

Figure 8:
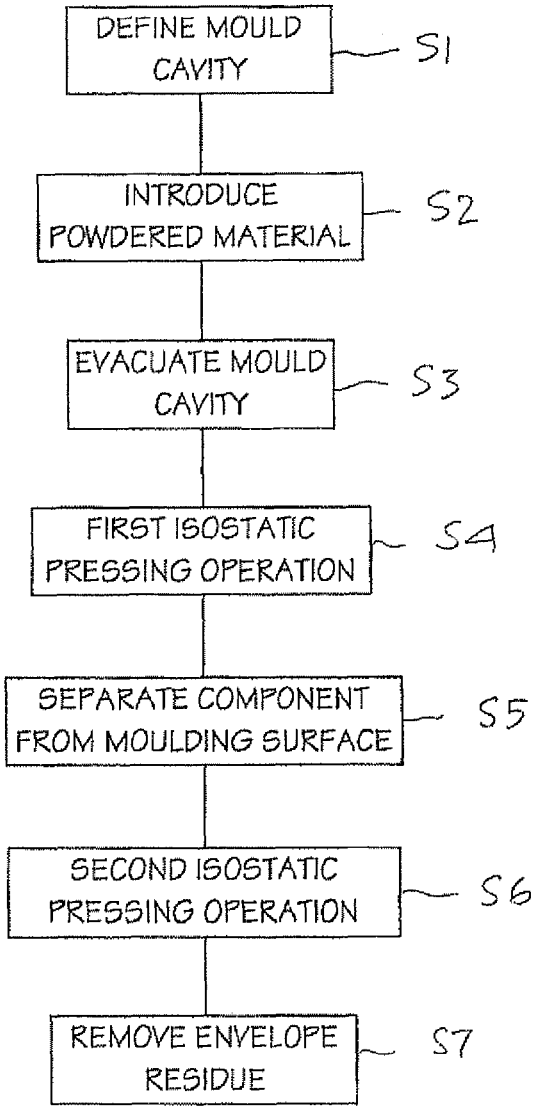
FIG. 8 is a flowchart of the manufacturing process.

With regard to FIG. 8, the definition of the mould cavity 10 within the envelope 4 constitutes a first step S1 of the manufacturing process. Subsequently, in step S2, a powdered metallic alloy is introduced into the mould cavity 10. The powder may comprise a loose powder which is introduced to the mould cavity 10 through the inlet passage 6. The powdered material may be a metal alloy, for example a titanium alloy such as Ti6/4.

Figure 2:
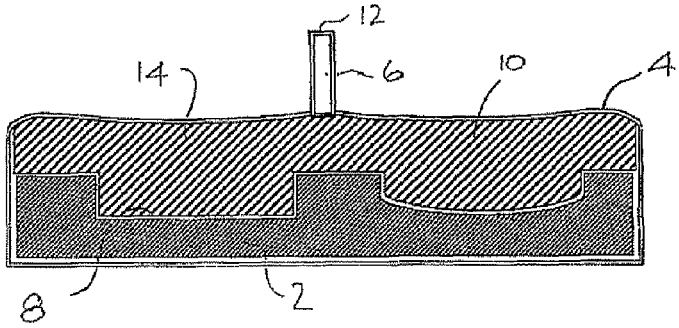
FIGS. 2 to 4 represents second to fourth steps in the manufacture of the component.
Figure 3:
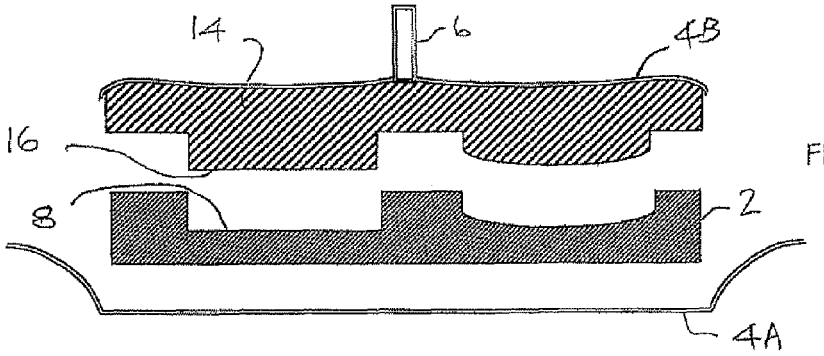

When the mould cavity 10 has been filled with the powder, any remaining air or other gas in the mould cavity 10 is evacuated in step S3. This evacuation occurs through the inlet passage 6. Subsequently, in step S4, a first isostatic pressing operation is conducted. For this operation, the inlet passage 6 is sealed as indicated in FIG. 2 at 12, and the envelope 4 is subjected to a hot isostatic pressing (HIP) operation in which the envelope 4 and its contents are placed in a fluid, such as an inert gas environment (for example in argon). The pressure and temperature of the inert gas are then raised to heat the powdered material 14 in the mould cavity 10 and to apply isostatic pressure to it through deformation of the envelope 4 as shown in FIG. 2.

The temperature and pressure are selected to achieve partial consolidation of the powder 14. For example, where the powder 14 is a titanium alloy such as Ti6/4, the assembly may be heated to a temperature in the range 700° C. to 800° C., for example to 750° C., and the pressure may be raised to a pressure in the range 50 MPa to 200 MPa, for example 100 MPa. The temperature and pressure conditions are such that, although the bulk powder is only partially consolidated, the surface of the powder 14 in contact with the moulding surface 8 becomes fully sealed, i.e. non-porous. Also, although the temperature and pressure are sufficient to cause bonding between the powder 14 and the envelope 4, they are not sufficient to cause any bonding or reaction with the moulding tool 2.

On completion of the first isostatic pressure operation, the envelope 4 is cut away to release the moulding tool 2. Thus, a part 4A of the envelope 4 is discarded, while a further part 4B remains bonded to the powder 14 which, at this stage, constitutes a partially consolidated component. At step S5 in FIG. 8, the moulding tool 2 is separated from the partially consolidated component 14, which now has a non-porous shaped surface 16 which is complementary to the moulding surface 8 of the moulding tool 2. Consequently, in combination with the remaining part 4B of the envelope 4, the partially consolidated component 14 has an entirely non-porous outer surface so that no ambient atmosphere can penetrate into the spaces between the individual particles of the powder.

Figure 4:
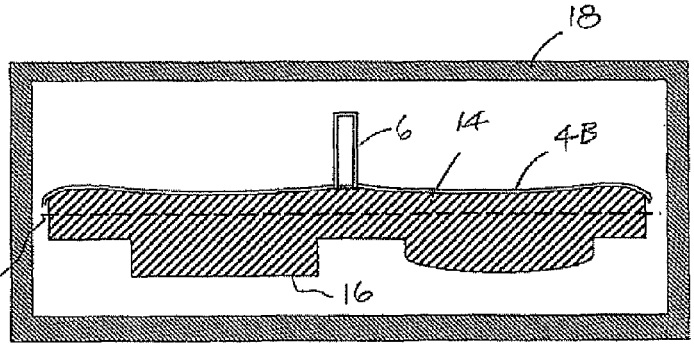

In step S6, the partially consolidated component 14, with the remaining part 4B of the envelope 4, is subjected to a second hot isostatic pressing operation, as shown in FIG. 4. FIG. 4 schematically shows the partially consolidated component within a pressure vessel 18 in which the HIP process is conducted. Such a pressure vessel 18 will also be employed in the first HIP process, represented in FIG. 2. In the second HIP process S6, the pressure of the inert gas in the vessel 18 is applied directly to the non-porous shaped surface 16 on the underside of the component 14 as shown in FIG. 4, while the pressure acts on the upper surface of the component 14 through the remaining part 4B of the envelope 4. Thus it will be appreciated that, during the second HIP operation, there is no requirement for tooling to control the profile of the non-porous shaped surface 16.

The second HIP process is conducted at a higher temperature than the first HIP process S4 represented in FIG. 2. Thus, for example, the temperature within the vessel 18 may be raised to a temperature in the range 850° C. to 1000° C., for example 920° C. The pressure in the vessel 18 may be the same as that in the first HIP process S4, but a different pressure, for example a higher pressure, may be used.

Since the external surface of the partially consolidated component 14 is non-porous, the second HIP process will cause further consolidation of the partially consolidated powder. This involves additional contraction of the partially consolidated component 14 by, for example, less than 1%. Consequently, during the second HIP process S6, any residual porosity in the component 14 is substantially eliminated, and the microstructure of the component 14 is substantially interdiffused and assimilated. In some circumstances, it may also be possible to vacuum heat treat the component 14 to achieve full densification with the required microstructure whilst maintaining the clean unoxidised shaped surface 16.

Following the second HIP process S6, the residual part 4B of the envelope 4 can be removed from the fully consolidated component 14 by cutting through the component as indicated by the dashed line 20. The resulting surface caused by the machined cut 20 may be a planar surface, or a more complex machining operation may be performed to provide a desired profile.

It will be appreciated that the moulding tool 2, once separated from the partially consolidated component 14, can be reused. This is in contrast to known HIP processes, in which the envelope 4 deforms to provide the required shaped surface 16 after consolidation, and bonds to the resulting component. The envelope 4 thus has to be destroyed in order to remove it from the consolidated component. Also, the configuration of the envelope 4 in conventional HIP processes must be established so that, after consolidation of the powdered material and the associated deformation of the envelope 4, the required net shape of the component is achieved. In a process in accordance with the invention, as described above, the near net shape of the non-porous shaped surface 16 is achieved by the rigid moulding tool 2, and only a small "free" deformation of the surface 16 occurs during the second HIP process S6. Consequently, the achievement of an accurate net shape surface becomes easier.

Figure 5:
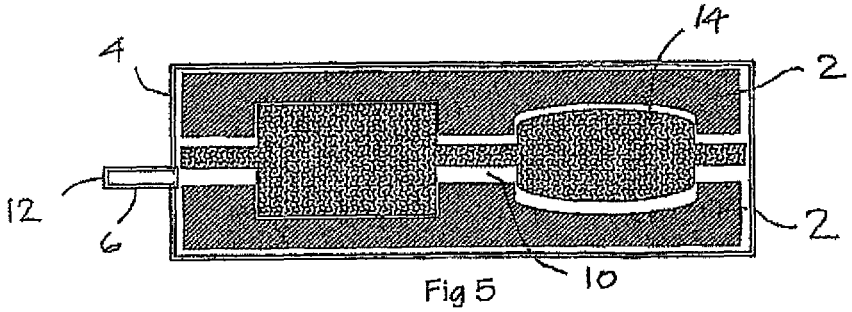
FIGS. 5 to 7 represent, in schematic forms, steps in an alternative method of manufacturing a component.
Figure 6:
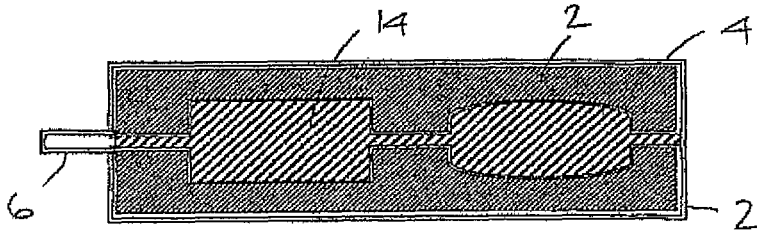
Figure 7:
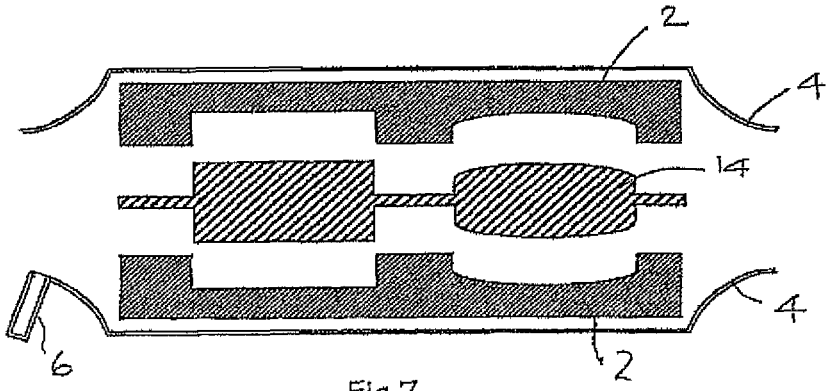

FIGS. 5 to 7 show an alternative process in which a complete net shape component can be achieved over substantially the full surface of the component. In the process of FIGS. 5 to 7, the mould cavity 10 is defined substantially entirely between two mould tools 2 accommodated within the envelope 4.

In this process, instead of introducing the powdered material 14 as a loose powder, a preformed powder block is disposed between the moulding tools 2 before they are encased in the envelope 4. As with the process represented in FIGS. 1 to 4, the mould cavity 10 and the preformed block 14 are evacuated through the passage 6 which is subsequently sealed at 12. The first HIP process S4 is shown in FIG. 6 and may be conducted under the same conditions as described with reference to FIG. 2. The preformed block 14 is thus consolidated and its entire external surface is sealed. Subsequently, in step S5, the envelope 4 is cut open and can be discarded in its entirety. The moulding tools 2 are then separated from the partially consolidated component 14, and the partially consolidated component 14 is then subjected to a second HIP process S6 in the same manner as described with reference to FIG. 4. Of course, since there is no residual casing part 4B in the process with reference to FIGS. 5 to 7, no subsequent step S7 is required, although some final finishing machining operations may be necessary.

The preformed block 14 (FIG. 5) may be made in more than one section, and different regions of the block and/or different sections, may be compacted to different extents, so that the powder is distributed, in the initial state, in a manner which provides even consolidation throughout both the first and second HIP process S4, S6. For example, the thicker component sections will require a greater density of powder in order to achieve the same consolidation across the component 14 during the HIP processes S4, S6. The preformed block may, for example, be made in a light sintering process in a shaped crucible or canister, and may employ a powder binder such as is used in metal injection moulding or cold pressing.

Figure 9:
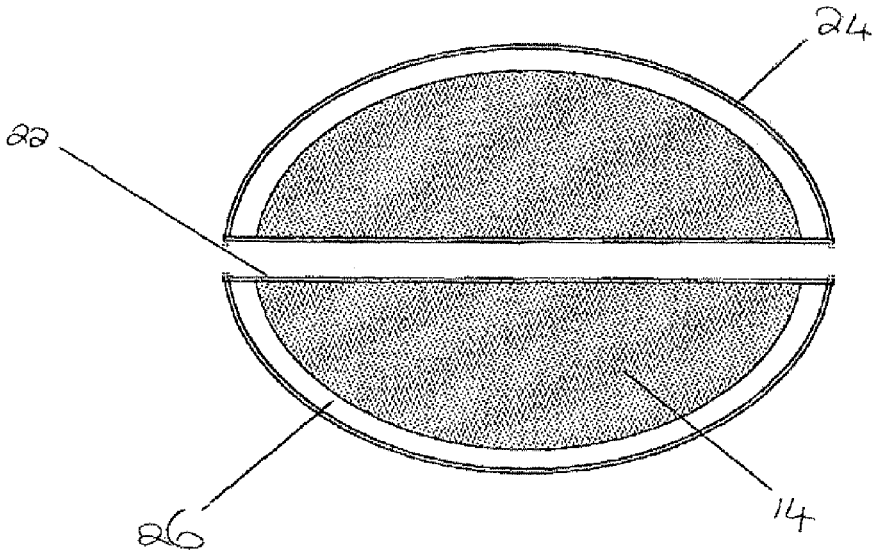
FIG. 9 represents, in a schematic form, an assembly for the manufacture of a hollow component according to the present invention.
Figure 10:
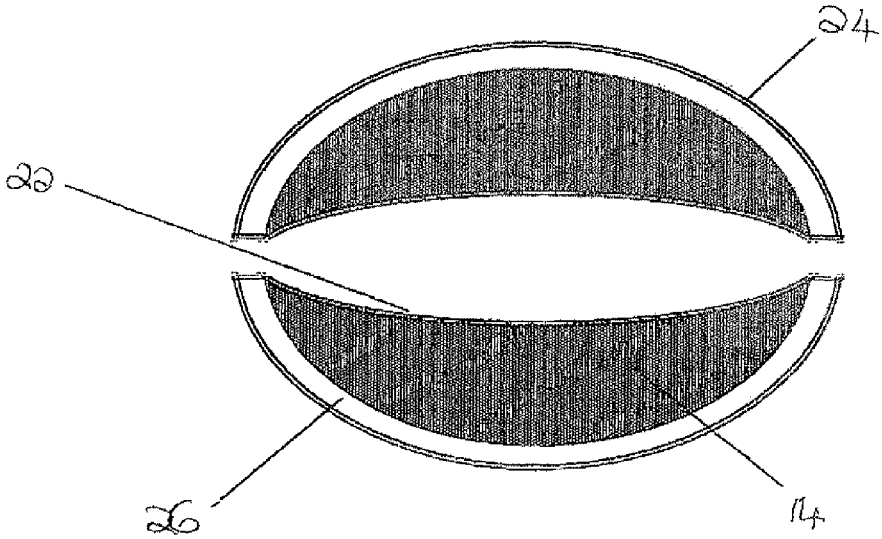
FIG. 10 shows the assembly of FIG. 9 following a hot isostatic pressing process.

As shown in FIGS. 9 and 10, it is also possible to produce hollow components in processes in accordance with the present invention. A thin walled hollow chamber 22 (for example a thin walled mild steel tube 22) is connected to the surface of an envelope 24, and extends through the volume defined by the envelope 24. Hence the tube/chamber 22 defines part of the sealed evacuated cavity which envelopes the powder 14, and the inner surface of the tube/chamber 22 is exposed to the hot isostatic pressing operating fluid (as described with respect to the previous embodiments). Thus when the operating fluid is pressurised during a first isostatic pressure operation, the chamber/tube 22 expands to consolidate the powder 14 against outer non-deformable tooling 26 to form a hollow component. On completion of the first isostatic pressure operation, the envelope 24 is cut away to release the moulding tool 26 from the partially consolidated component 14. The partially consolidated component 14 is then subjected to a second isostatic pressure process S6 in the same manner as the previously described embodiments.

The present invention thus provides a process for achieving relatively low cost components, requiring relatively inexpensive moulding tools 2, 26. Since net shape or near net shape components can be achieved, minimal subsequent machining is required, leading to an increased fly-to-buy ratio compared with other manufacturing processes, and in particular ring-rolled forging processes. Similarly, compared with ring-rolled forging processes, less scrap material is produced, and lead times are reduced. Compared with conventional HIP processes, a process in accordance with the present invention enables rapid prototyping since the moulding tools 2, 26 are relatively easy to produce by comparison with fabricated metal canisters for conventional HIP processes. Also, there are environmental benefits in avoiding the need to remove the metal canisters of conventional HIP processes by chemical pickling or extensive machining operations.

Since the non-porous shaped surface 16 of the partially consolidated component 14 is defined by the rigid moulding tool 2,26 which does not deform under the first HIP process S4, and since this shaped surface 16 is close to the final surface profile after the second HIP process S6, sophisticated computer moulding and iterative trial processes required for the design of metal canisters of conventional HIP processes are eliminated. Further economic benefits arise from the ability to reuse the moulding tools 2,26.

Processes in accordance with the present invention can be used to manufacture components made from hybrid alloys, i.e. with different parts of the component having different alloy compositions.

The invention claimed is:

1. A method of manufacturing a component, the method comprising:

(i) defining a mould cavity within a deformable envelope, at least a portion of the mould cavity being defined by a moulding surface of a rigid moulding tool;

(ii) introducing a porous powdered material into the mould cavity;

(iii) evacuating the mould cavity;

(iv) forming a partially consolidated component by subjecting the deformable envelope to a first external isostatic pressing operation at a first temperature, thereby to deform the envelope to consolidate the powdered material to such an extent that the powdered material in contact with the moulding surface forms a non-porous shaped surface;

(v) separating the partially consolidated component from the moulding surface and removing the rigid moulding tool; and (vi) forming a fully consolidated component by exposing the shaped surface to a fluid under pressure and subjecting the partially consolidated component to a second external isostatic pressing operation at a second temperature higher than the first temperature, thereby to consolidate the powdered material substantially fully, in which, following separation of the partially consolidated component from the moulding surface, and before the second external isostatic pressing operation, at least part of the envelope is removed to enable separation of the moulding tool from the respective non-porous shaped surface.

2. A method as claimed in claim 1, in which the powdered material is a metallic material.

3. A method as claimed in claim 2, in which the powdered material is a titanium alloy.

4. A method as claimed in claim 1, in which the envelope comprises a thin-walled metallic enclosure.

5. A method as claimed in claim 1, in which the moulding tool is disposed entirely within the envelope.

6. A method as claimed in claim 1, in which the envelope directly contacts the powdered material.

7. A method as claimed in claim 1, in which the moulding tool is one of at least two moulding tools which are displaceable towards one another upon deformation of the envelope during the first external isostatic pressing operation.

8. A method as claimed in claim 1, in which the porous powdered material is introduced into the mould cavity as a loose powder.

9. A method as claimed in claim 1, in which the porous powdered material is introduced into the mould cavity as a powder preform.

10. A method as claimed in claim 1, in which the second external isostatic pressing operation is performed with part of the envelope attached to the partially consolidated component.

11. A method as claimed in claim 10, in which the attached part of the envelope is removed from the fully consolidated component by machining through the substantially fully consolidated component.

* * * * *